United States Patent [19]

Miller et al.

[11] 4,358,746

[45] Nov. 9, 1982

[54] ROTARY COUPLING JOINT

[75] Inventors: Coleman J. Miller, Arnold, Md.; James K. Conn, Indialantic, Fla.

[73] Assignee: Westinghouse Electric Corp., Pittsburgh, Pa.

[21] Appl. No.: 219,091

[22] Filed: Dec. 22, 1980

[51] Int. Cl.[3] ..... H01P 1/06

[52] U.S. Cl. ..... 333/261; 343/763

[58] Field of Search ..... 343/758, 762, 763, 766; 333/261

[56] References Cited

U.S. PATENT DOCUMENTS

| | | | |
|---|---|---|---|
| 2,623,999 | 12/1952 | Kulikowski | 343/766 |
| 3,546,699 | 12/1970 | Smith | 343/762 |
| 3,604,009 | 9/1971 | Behnke | 343/763 |
| 4,258,365 | 3/1981 | Hockham et al. | 343/763 |

FOREIGN PATENT DOCUMENTS

| | | | |
|---|---|---|---|
| 1033991 | 7/1953 | France | 333/261 |

*Primary Examiner*—Eli Lieberman

*Attorney, Agent, or Firm*—J. B. Hinson

[57] ABSTRACT

A rotary coupler for coupling a microwave signal to a rotating antenna is disclosed. The preferred embodiment comprises a section of waveguides formed into a circle and split into two pieces along the long wall of the waveguide. The two sections of waveguide are positioned to rotate with respect to each other with energy coupled into one portion of the waveguide along its narrow wall and coupled out of the second portion along its narrow wall. An isolation element is utilized at both the input and output ports to assure directional coupling into the split wall waveguide. More than one of the coupling devices can be monitored around a ship's mast, for example, to couple a plurality of microwave systems to a single multiple bandwidth rotating antenna.

3 Claims, 10 Drawing Figures

ROTARY COUPLING JOINT

BACKGROUND OF THE INVENTION

1. Field of the Invention:

The invention relates to microwave coupling devices and more particularly to rotary microwave couplers utilizing waveguides.

2. Description of the Prior Art:

Typical prior art rotary coupling devices were in the order of one wavelength long. Utilizing these joints with multiple bandwidth antennas, in an application such as a shipboard radar system, required the antenna to be mounted at the side of the mast. This could lead to a considerable "dead spot" due to shadowing by the mast. Other couplers also involved complicated timing devices.

SUMMARY OF THE INVENTION

The invention comprises a split wall waveguide coupling device and an antenna system using such a coupling device. The split wall waveguide coupling device includes first and second surfaces each having first and second grooves therein. The surfaces are positioned such that the first grooves become a split wall waveguide with the two surfaces free to rotate with respect to each other. Radiation leakage at the split wall is prevented by chokes formed by the second grooves. The preferred use of the coupling devices is in a rotating antenna system where the coupling devices are used as "around the mast coupling device" to permit multiple bandwidth antenna to be mounted on a common pedestal.

DESCRIPTION OF THE PREFERRED EMBODIMENT

Figure 1:
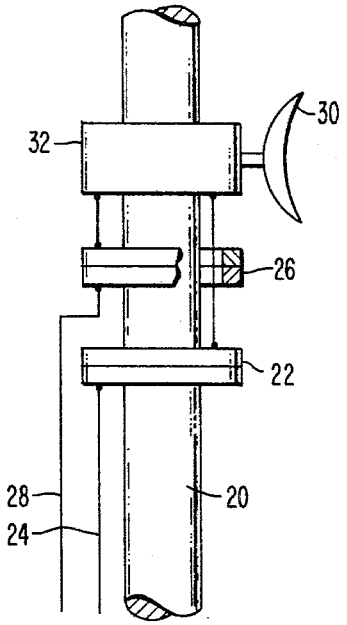
FIGS. 1 and 2 schematically illustrate an antenna system using first and second embodiments of a split wall waveguide coupler, respectively.

FIG. 1 is a schematic diagram of a multiple bandwidth antenna system using two split wall waveguide couplers 22 and 26, of a type comprising an embodiment of the invention. The first coupler 22 is mounted around the mast 20 with the microwave input signal being supplied by a first section of waveguide illustrated functionally at reference numeral 24. A second coupler 26 is also positioned just above the first coupler 22. A microwave input signal is provided to the second coupler 26 by second section of waveguide 28. The output ports of the couplers 22 and 26 are coupled to an antenna 30 and rotate therewith. The antenna system 30 is supported by a pedestal 32 which includes all or the necessary drive and support apparatus.

Figure 2:
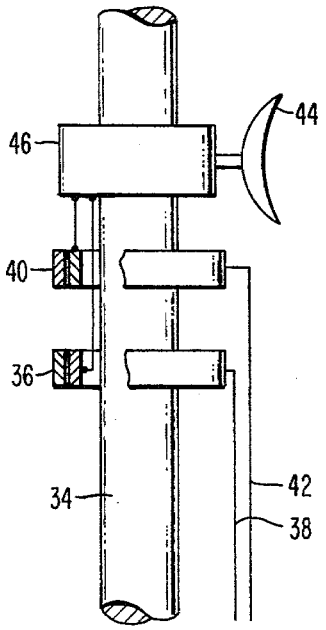

The use of a second embodiment of the split wall waveguide coupler is schematically illustrated in FIG. 2. This embodiment is also primarily intended for use on a mast, such as a ship's mast, a fragmentary portion of which is illustrated at reference numeral 34. A first coupler 36 is mounted around the mast 36 and coupled to receive a microwave input signal at the input port via a section of waveguide line 38. A second coupler 40 is also positioned around the mast 34 and immediately above the first coupler 36 and supplied with a microwave input signal at the input port via a second waveguide illustrated at reference numeral 42. Energy is coupled from the couplers 36 and 40 to an antenna 44 via a conventional antenna pedestal 46.

Figure 3:
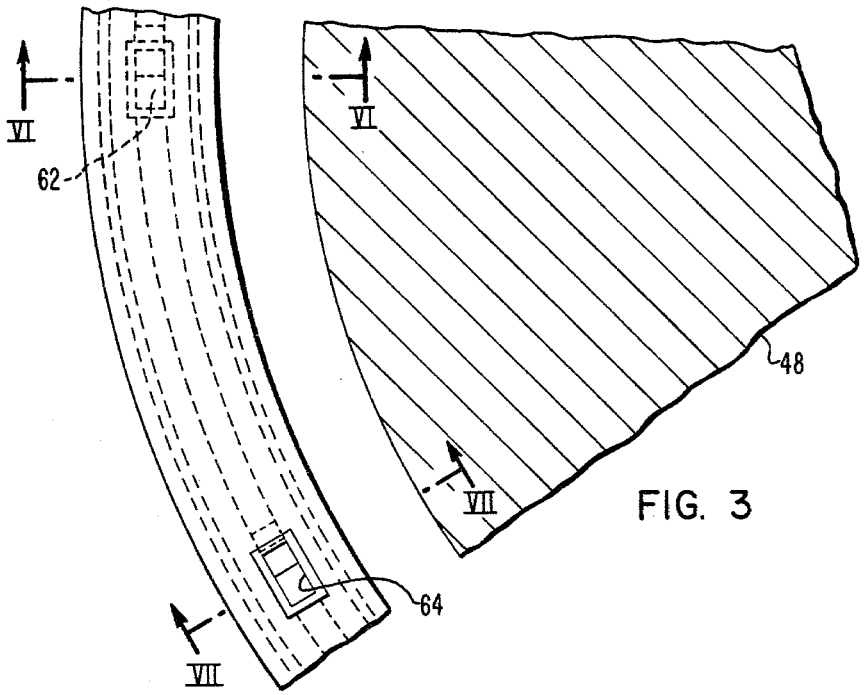
FIG. 3 is a fragmentary top view of one embodiment of the split wall waveguide coupler.

FIG. 3 is a top view of a segment of a split wall waveguide coupler of the type illustrated in FIG. 1. A fragmentary section of the mast is illustrated at reference numeral 48. The split wall waveguide coupler includes a section of split wall waveguide with the first or top section illustrated at reference numeral 50 in FIGS. 4, 5 and 6. Similarly the bottom section of the split wall waveguide is illustrated at reference numeral 52 in these same Figures. Structurally, the top section 50 includes a first groove 54 which ultimately forms a portion of the cavity of the split wall waveguide and a second groove 56 which forms a choke for preventing RF energy from escaping through the space between the first and second members 50 and 52. Similarly, the bottom section 52 includes a first groove 58 and a second groove 60. Grooves 54, 56, 58 and 60 are all circular and the first and second members 50 and 52 are supported on a central axis such that grooves 54 and 58 are immediately adjacent to each other and positioned to form a circular section of divided wall rectangular waveguide. Obviously suitable mounting and bearing means must be provided to support members 50 and 52 in this relative position and permit them to rotate with respect to each other. This may be accomplished in any conventional manner, and thus no detailed structure for performing this function is illustrated. Similarly, the space between the adjacent surfaces of members 50 and 52 may require sealing means to protect the split wall waveguide from the surrounding environment. This function may also be supplied using conventional techniques, and therefore it is not illustrated in detail.

RF energy is coupled into the coupler through an input port 62 and out of an output port 64. Basically what the input and output ports comprise is a modified T section of waveguides coupled into the short wall of the split wall waveguide section formed by grooves 54 and 58. Additionally, the input and output ports include an isolation device to assure that at the input port energy is coupled into the split wall waveguide in only one direction and at the output port it is only coupled out from one direction. These features will be subsequently described in more detail.

Figure 4:
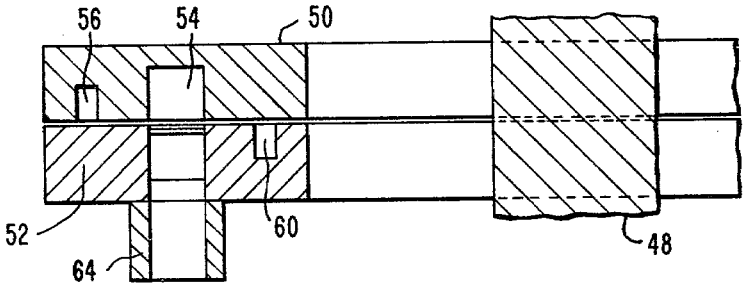
FIG. 4 is a cross section of the split wall waveguide coupler illustrated in FIG. 3 taken along the input port of the coupler.

FIG. 4 is a cross section taken along the central portion of the input port 62. The T section coupler of course includes an opening in the narrow wall of the split wall waveguide comprising the coupler and a short section of similar waveguide affixed to the bottom member 52 of the coupler. This additional short section of waveguide is illustrated at reference numeral 64. The isolation device utilized at both the input and output points will be described in more detail with reference to FIG. 6.

Figure 5:
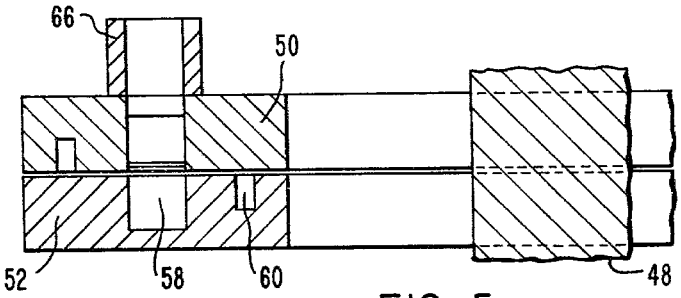
FIG. 5 is a cross section of the split wall waveguide coupler illustrated in FIG. 3 taken in cross section along the output port.

FIG. 5 is a similar cross section taken along the output port 64. Structurally, the input and output ports are identical with the identical piece of waveguide comprising the modified T section of the output port being illustrated at reference numeral 66.

As previously described the input and output ports of the coupler are identical except that one port is in the upper portion 50 and the other port is in the lower portion 52. Therefore, the following description of the isolation device is equally applicable to both the input and output ports.

Figure 6:
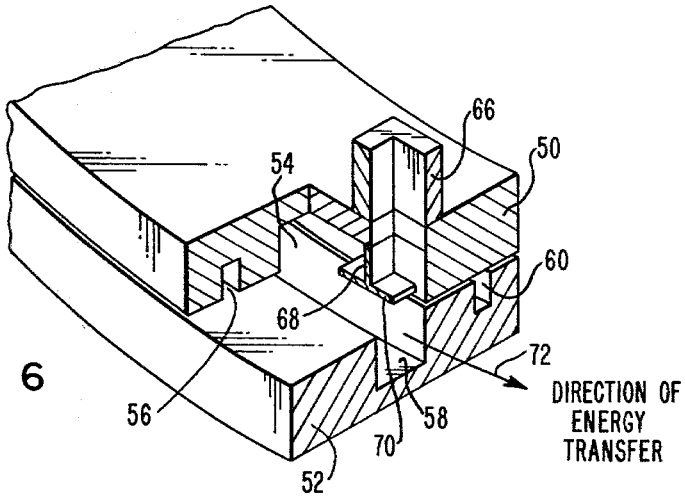
FIG. 6 is an isometric view of the input port of the split wall waveguide coupler illustrated in FIG. 3.

As previously discussed, the input port 62 and the output port 64 both include isolation devices to assure that coupling into the major portion of the split wall waveguide from the input ports is in one direction. This is accomplished by an isolation device which includes a first wall portion 68 (FIG. 6) which is affixed to the short wall of the waveguide portion formed by groove 54 and extends into the waveguide at substantially right angles to the short wall. A second wall portion 70 is affixed to the first wall portion to form a T-shaped structure as illustrated in FIG. 6. This structure forms a directional coupler such that energy is transferred in a direction illustrated generally by an arrow 72 in FIG. 8. The directional isolation of the structure comprising the first wall portion 68 and the second wall portion 70 is greater than 55 dB. The coupler described above is bidirectional. Therefore, in the transmit mode it can be used to couple a high level microwave signal from a transmitter to the antenna and to couple a reflected signal from the antenna to a receiver.

Figure 7:
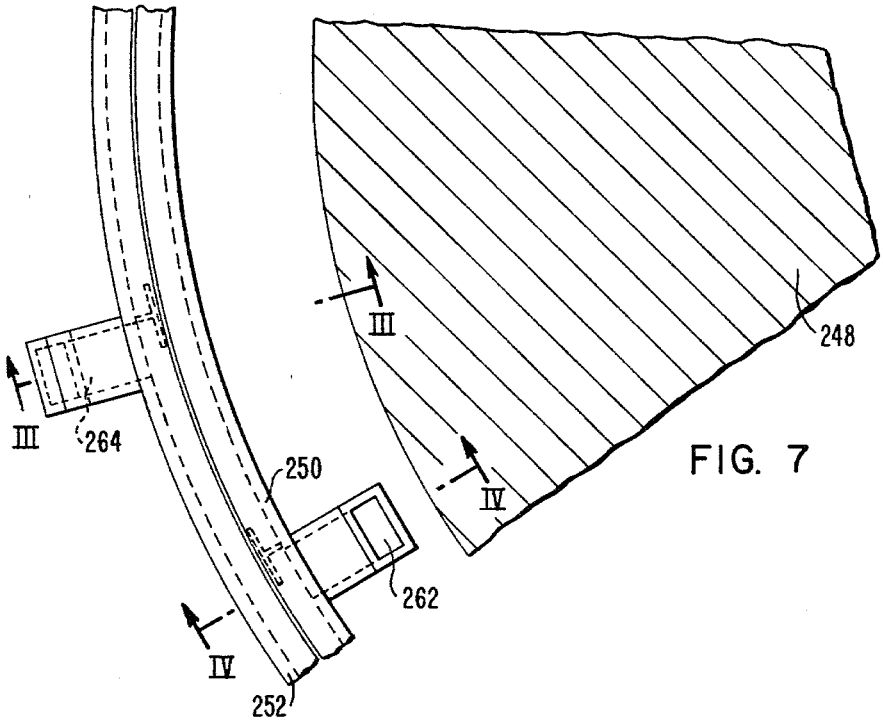
FIG. 7 is a partial fragmentary top view of a second embodiment of the split wall waveguide coupler.
Figure 8:
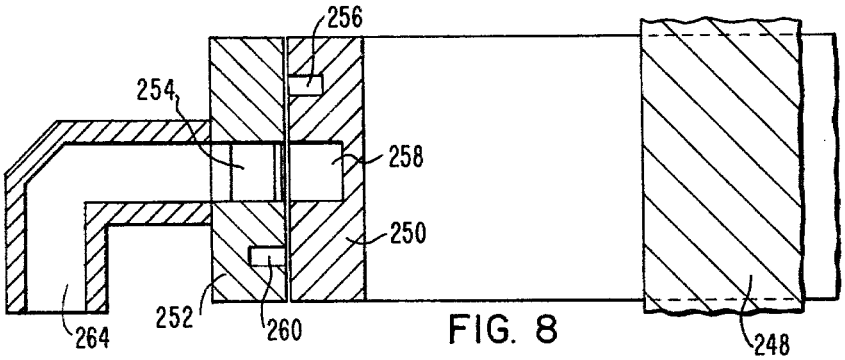
FIG. 8 is a cross section view of the split wall waveguide coupler illustrated in FIG. 7 taken along the input port.
Figure 9:
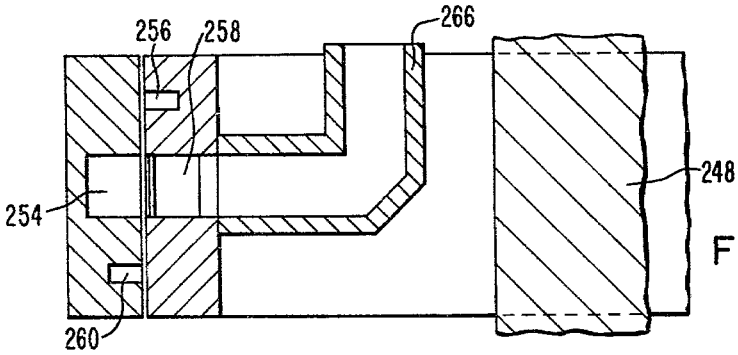
FIG. 9 is a cross section view of the split wall waveguide coupler illustrated in FIG. 7 taken along the output port.

A second embodiment of the split wall waveguide coupler is shown in top view in a fragmentary section in FIG. 7. Essentially the second embodiment is a modification of the first with the modification being a rotation of the members of the split wall waveguide 90° such that the long wall of is perpendicular to the axis rotation of the coupler. As an aid in showing the similarity of the parts the reference numerals used in the first embodiment preceded by a digit 2 have been used in FIGS. 7, 8, 9 and 10. Additionally the FIGS. 7, 8, 9 and 10 have been chosen to show view of the split wall waveguide coupler identical to those used in the first embodiment. For example, FIG. 7 is a fragmentary top view, FIG. 8 is a cross section through the input port, FIG. 9 is a cross section through the output port and FIG. 10 is a cross section through the output port to illustrate the isolation device.

More specifically, the mast supporting the split wall waveguide coupler is shown at reference numeral 248. The split wall waveguide coupler comprises two rotary sections 250 and 252 with the first section 250 being the inner or smaller radius section and the outer section 252 having a larger diameter. The inner section includes a first groove 258 (FIG. 8) which forms half of the split wall waveguide portion and a groove 256 which comprises a choke to prevent leakage between the first member 250 and the second member 252. Similarly, the second member 252 includes a groove 254 forming the major cavity of the split wall waveguide and a second groove 260 which forms a choke to prevent leakage along the split wall. The members 250 and 252 are mounted by suitable bearing and rotating means such that they can rotate with respect to each other to provide a rotary coupling with the input at port 264 and the output at port 266. As in the previous embodiment no detail structure for performing this function is shown because it is believed to be a relatively straightforward design problem.

Figure 10:
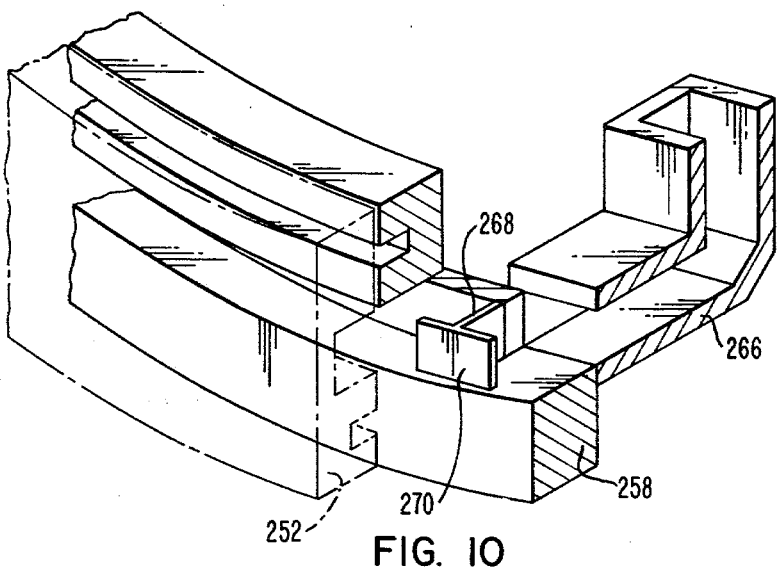
FIG. 10 is a partial isometric drawing illustrating the structure of the input and output ports of the split wall waveguide coupler illustrated in FIG. 7.

The input and output ports of the second embodiment are identical, therefore only one of these have been shown in FIG. 10 to illustrate the details. As in the previous embodiment coupling is provided to the split wall waveguide by a modified T section 266 affixed to the inner member 250 with a suitable opening being made in the short wall of the split wall waveguide. Isolation and directional coupling is provided by a first wall portion 268 affixed to the short wall of the waveguide and a second wall portion 270 affixed to the first in a T-like structure which extends into the waveguide. Isolation is provided in a fashion identical to the previous embodiment.

The detailed dimensions of the waveguides will obviously depend on the operating frequency. Similarly, the dimensions of the first and second wall portions 268 and 270 will also depend on the operating frequency. However, it is obvious that since the two members must rotate with respect to each other that the T structure comprising the isolation device must not extend beyond the inner edge of the member of the split wall waveguide to which it is affixed. Additionally, the interface surfaces between the major members of the split wall waveguide do not necessarily have to comprise totally flat surfaces so long as the proper dimensions are maintained to permit the grooves to operate in a satisfactory manner as chokes at the operating frequency. For example, the groove 60 forming the choke in member 52 of FIG. 6 could be in an edge wall of member 52 at an angle 90° with respect to that illustrated. This would obviously require a similar modification in member 50 to permit the groove to function as a choke. These modifications are believed to be obvious to those skilled in the art.

We claim:

1. A coupling device comprising:

(a) first and second surfaces each having first and second grooves therein, each having substantially flat wall and bottom portions to form a rectangular cross-section, said bottom portion being narrower than said wall portion;

(b) means for positioning said first and second surfaces adjacent each other such that said first grooves form a circular section of divided wall waveguide with said second grooves being on opposite sides of said split wall waveguide to form chokes which prevent leakage of RF energy from said split wall waveguide along said split wall;

(c) first and second "T" coupling sections intersecting each of the narrow walls of said split wall waveguide; and (d) an isolation device comprising first and second plate-like portions, said first portion being affixed to said short wall of said split waveguide at a point where said short wall intersects said "T" coupling section, said second portion being affixed to the end of said first plate-like portion to form an insulator having a first portion which is affixed to the short wall of said split wall waveguide and extends inwardly toward the opposite short wall of said split wall waveguide and a second portion affixed to said portion and extending along said split wall waveguide in a direction substantially parallel to said narrow walls.

2. A coupling device in accordance with claim 1 wherein said bottom portion is positioned at an angle of substantially 90° with respect to the axis of said circular section of split wall waveguide.

3. A coupling device in accordance with claim 1 wherein said bottom portion is substantially parallel to the axis of said circular split wall waveguide.

* * * * *